US011154962B2

(12) United States Patent
Kamimura et al.

(10) Patent No.: US 11,154,962 B2
(45) Date of Patent: Oct. 26, 2021

(54) BURNISHING TOOL

(71) Applicant: SUGINO MACHINE LIMITED, Uozu (JP)

(72) Inventors: Daichi Kamimura, Uozu (JP); Masaru Futamura, Uozu (JP)

(73) Assignee: SUGINO MACHINE LIMITED, Uozu (JP)

( * ) Notice: Subject to any disclaimer, the term of this patent is extended or adjusted under 35 U.S.C. 154(b) by 33 days.

(21) Appl. No.: 15/914,700

(22) Filed: Mar. 7, 2018

(65) Prior Publication Data

US 2018/0345450 A1 Dec. 6, 2018

(30) Foreign Application Priority Data

May 31, 2017 (JP) ..... JP2017-108813

(51) Int. Cl.
*B24B 39/06* (2006.01)
*B24B 47/02* (2006.01)
*B24B 39/04* (2006.01)

(52) U.S. Cl.
CPC ..... *B24B 39/06* (2013.01); *B24B 39/04* (2013.01); *B24B 47/02* (2013.01)

(58) Field of Classification Search
CPC ..... B24B 39/06; B24B 39/04; B24B 47/02
See application file for complete search history.

(56) References Cited

U.S. PATENT DOCUMENTS 3,059,315 A * 10/1962 Chambers ..... B24B 39/023 29/90.01
8,601,659 B2 * 12/2013 Prevey ..... B24B 39/003 29/90.01
2014/0149053 A1 * 5/2014 Sun ..... C21D 7/08 702/33

FOREIGN PATENT DOCUMENTS

| | | | |
|---|---|---|---|
| DE | 102016002923 | A | 9/2017 |
| JP | S50-155433 | A | 12/1975 |
| JP | S52-104629 | U | 8/1977 |
| JP | S60-190560 | U | 12/1985 |
| JP | S62-035762 | U | 3/1987 |
| JP | 2000-225565 | A | 8/2000 |
| JP | 2004-122331 | A1 | 4/2004 |
| JP | 2004122331 | A * | 4/2004 |
| JP | 2010-234511 | A | 10/2010 |
| JP | 5005406 | B2 | 8/2012 |
| JP | 2017-205827 | A | 11/2017 |

OTHER PUBLICATIONS

Machine Translation of JP2004122331A. "Smooth Surface Processing Chip and Smooth Surface Processing Tool using it" by Abe Mitsuru. Apr. 22, 2004 (Year: 2004).*
Office Action dated Mar. 20, 2019 in corresponding Korean patent application No. 10-2018-0025072 (5 pages).
(Continued)

*Primary Examiner* — David P Bryant
*Assistant Examiner* — Nirvana Deonauth
(74) *Attorney, Agent, or Firm* — United IP Counselors, LLC

(57) ABSTRACT

A burnishing tool uses a relatively small pressing load in burnishing. The burnishing tool for machining a target surface of a workpiece includes a base and a tip portion located on a distal end of the base. The tip portion includes a linear slide-contact portion that linearly contacts and slides on the target surface.

12 Claims, 11 Drawing Sheets

(56) References Cited

OTHER PUBLICATIONS

Office Action dated Jan. 28, 2020 in a corresponding Japanese patent application No. 2017-108813 (3 pages).
"Machining Technology Experience", Chung Chung Ti, National Defense Industrial Press, pp. 81-82, Jun. 2015.
Decision to Refusal dated Sep. 3, 2020 in a corresponding Chinese patent application No. 201810173740.3.

* cited by examiner

BURNISHING TOOL

CROSS-REFERENCE TO RELATED APPLICATIONS

This application claims the benefit of priority to Japanese Patent Application No. 2017-108813, filed on May 31, 2017, the entire contents of which are hereby incorporated by reference.

BACKGROUND

1. Technical Field

The present invention relates to a burnishing tool for finishing grooves or other surfaces.

2. Description of the Background

FIG. 8 is a graph showing the surface roughness of an end face finished by metal cutting using a general-purpose lathe. As shown in FIG. 8, sealing surfaces finished by metal cutting have the surface roughness Rz of typically about 3.2 to 6.3. The demand is increasing for burnishing tools that can provide improved finished surfaces with higher sealing performance.

A groove for receiving a seal such as an O-ring is typically formed by cutting a cylindrical workpiece using a cutting tool tip designed for O-ring groove machining. Despite the recent demand for higher sealing performance, O-ring grooves finished by such metal cutting can have rough surfaces and have low sealing performance, and may not easily achieve intended surface roughness.

To finish cut groove surfaces as intended and provide higher sealing performance, a burnishing tool for flat surfaces including the bottoms of grooves formed by metal cutting is known (e.g., Japanese Patent No. 5005406, hereafter Patent Literature 1).

The burnishing tool for flat surfaces described in Patent Literature 1 has a flat and circular press portion at the tip of a cylindrical (shaft) mandrel, which is pressed against a machining target surface of a workpiece for burnishing the bottom of a rectangular groove for an O-ring. A machine tool such as a lathe, which uses a selected type of burnishing tool for flat surfaces, presses its press portion against fine irregularities on the surface of a workpiece while rotating. This causes plastic deformation at the surface, which is thus finished into a smooth surface like a mirror surface.

BRIEF SUMMARY

The burnishing tool for machining flat surfaces described in Patent Literature 1 has the flat end face of its press portion in contact with the bottom of an O-ring groove on a workpiece for burnishing. The burnishing tool for machining flat surfaces uses surface contact with the workpiece, and thus applies a large machining load in the large surface contact area.

The burnishing tool for machining flat surfaces operates, with its tip to endure a large load. Unfortunately, the burnishing tool tip for machining flat surfaces described in Patent Literature 1 is difficult to strengthen any further. The tip strength of the tool currently limits its use to workpieces formed from a soft material such as aluminum.

One or more aspects of the present invention are directed to a burnishing tool that uses a relatively small pressing load in burnishing.

A burnishing tool for machining a target surface of a workpiece, the tool comprising:

a base; and a tip portion located on a distal end of the base, the tip portion including a linear slide-contact portion configured to linearly contact and slide on the target surface.

The burnishing tool according to the above aspects uses a relatively small pressing load in burnishing.

DETAILED DESCRIPTION

A burnishing tool according to one embodiment will now be described with reference to FIGS. 1 to 7.

Figure 1:
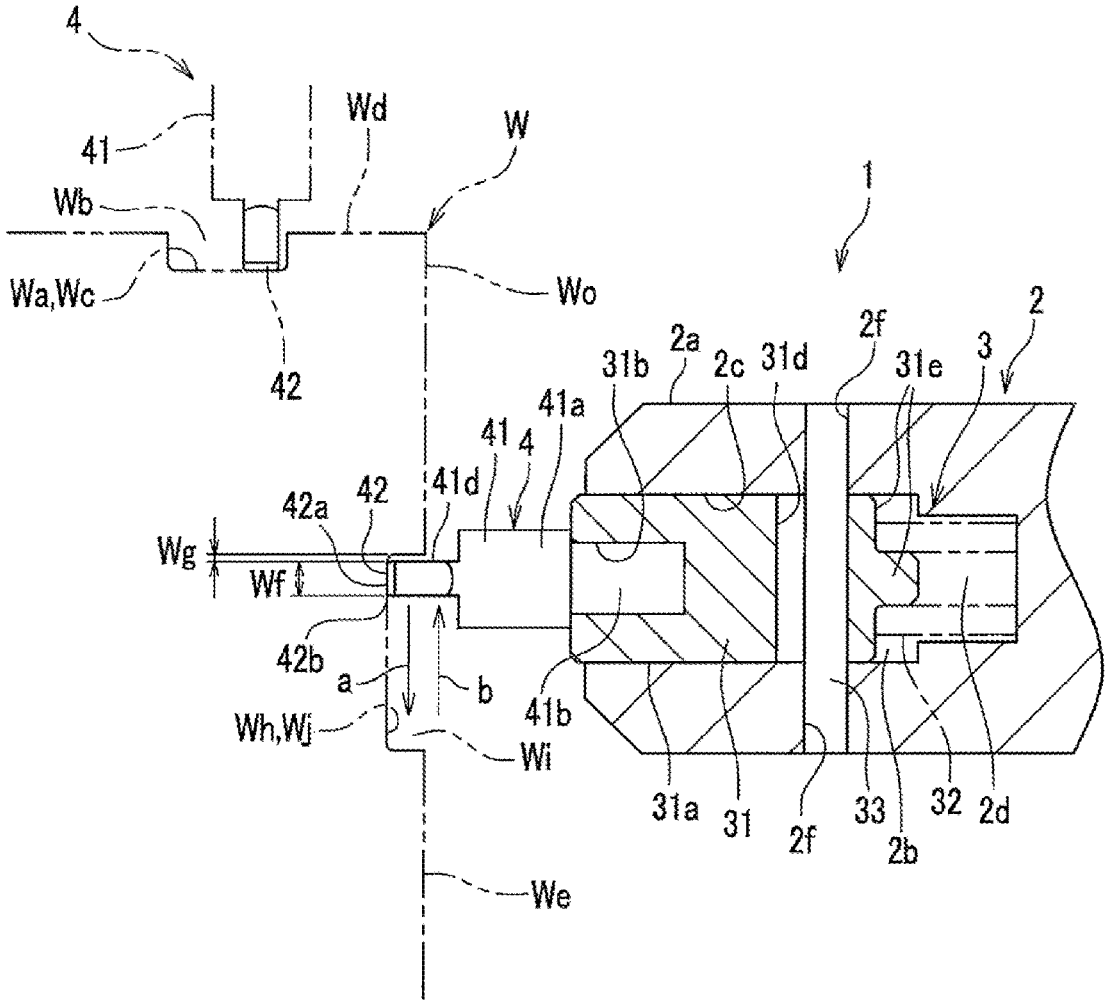
FIG. 1 is a vertical cross-sectional view of a main part of a burnishing tool according to one embodiment.

A finishing machine (not shown) to which a burnishing tool 1 is attached and a workpiece W will be described first. For ease of explanation, an end where a body 2 is located in FIG. 1 is referred to as a basal end, an end where a tip 4 is located in FIG. 1 is referred to a distal end, and the horizontal direction in FIG. 1 is referred to as an axial direction.

Finishing Machine

The finishing machine (not shown) is a machine tool that rotates the workpiece W attached to its drive, and aligns and feeds the burnishing tool 1 and the workpiece W. Examples of the finishing machine include a lathe, a milling machine, and a machining center. Burnishing (machining involving plastic deformation) using a lathe as the finishing machine will be described below.

Workpiece

The workpiece W shown in FIG. 1 has a target surface Wa against which a linear slide-contact portion 42*a* in the burnishing tool 1 (described later) is pressed for burnishing. The workpiece W is a metal piece such as a metal cylinder with a circular end face (cylindrical rod) or a flat metal plate. The workpiece W is formed from a metal material such as steel, an aluminum alloy, a copper alloy, and a die-cast material (e.g., an aluminum alloy, a zinc alloy, and a magnesium alloy).

Figure 4:
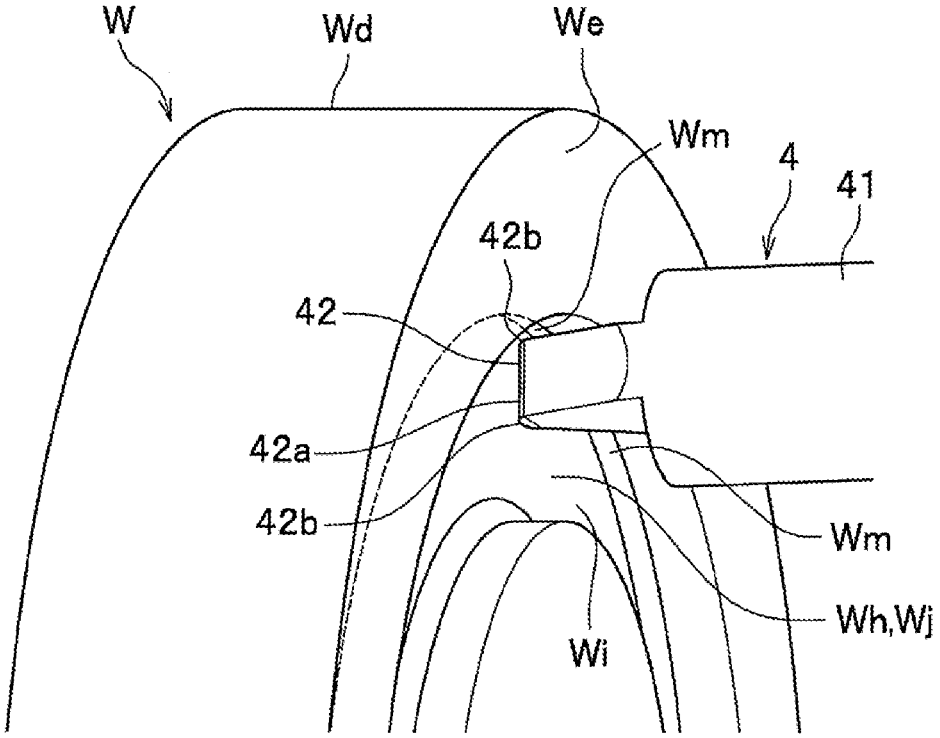
FIG. 4 is an enlarged perspective view of the main part showing the tip end used in burnishing a groove on an end face of a workpiece.

The target surface Wa may be a bottom Wc of a groove Wb on an outer circumferential surface Wd of a cylindrical member, or a flat bottom Wj of a groove Wi on an end face We of a cylindrical member shown in FIG. 4, or a stepped surface.

The grooves Wb and Wi shown in FIG. 1 may be narrow annular rectangular grooves or U-shaped grooves, such as O-ring grooves for receiving O-rings or oil seal grooves for receiving sealants such as oil seals.

In the example below, burnishing of the workpiece W, or a round rod having the grooves Wb and Wi, which are O-ring grooves or oil seal grooves, will be described.

Burnishing Tool

The burnishing tool 1 is used for burnishing target surfaces by flattening and smoothing them into mirror-finished surfaces. The burnishing tool 1 has the linear slide-contact portion 42*a* on its tip end 42 (tip portion) pressed against the target surface Wa or Wh (the bottom We of the groove Wb or the bottom Wj of the groove Wi) of the rotating workpiece W (refer to FIG. 4). The burnishing tool 1 in use has its body 2 attached to a tool post (not shown) of the finishing machine. The burnishing tool 1 includes the body 2, a load control 3, and a tip 4. The load control 3 is movable in the axial direction within in the body 2. The tip 4 is located on the front end of the load control 3.

Body

Figure 2:
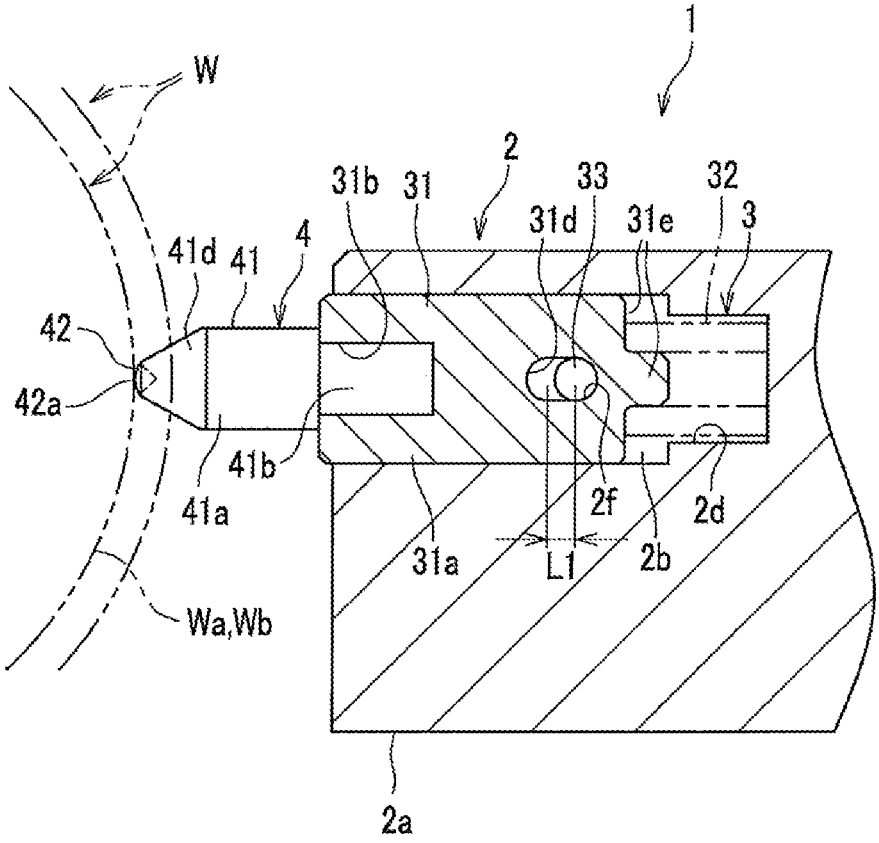
FIG. 2 is a horizontal cross-sectional view of the main part of the burnishing tool according to the embodiment.

As shown in FIGS. 1 and 2, the body 2 is a shank to be attached to the finishing machine. The body 2 supports a head joint 31, an urging member 32, and a support pin 33 included in the load control 3. The body 2 includes a shaft body 2*a*, a hollow part 2*b*, a head joint compartment 2*c*, an urging member compartment 2*d*, and a pin hole 2*f*.

As shown in FIG. 1, the shaft body 2*a* is attached to the tool post (not shown) of the finishing machine. The shaft body 2*a* may have any outer shape determined in accordance with the shape of an attachment receptacle in the finishing machine. When the shaft body 2*a* is attached to a tool post (not shown), the outer shape of the shaft body 2*a* may be a quadrangular prism (substantially square column).

The hollow part 2*b* is a stepped cylindrical space defined inside the shaft body 2*a*. The hollow part 2*b* includes the head joint compartment 2*c* and the urging member compartment 2*d*. The head joint compartment 2*c* accommodates the head joint 31 in a retractable manner. The urging member compartment 2*d* accommodates the urging member 32. The hollow part 2*b* may have no step, and may be a cylindrical space including the head joint compartment 2*c* and the urging member compartment 2*d* both with the same diameter.

The head joint compartment 2*c* is located on the distal end within the hollow part 2*b*. The head joint compartment 2*c* accommodates the head joint 31, which is urged by the urging member 32 toward the distal end with the support pin 33 abutting against an edge of an elliptic hole 31*d* on the basal end. The head joint 31 is located nearer the distal end by a distance corresponding to a difference between the outside diameter of the support pin 33 and the inside diameter of the elliptic hole 31*d* along its major axis. The head joint 31 is thus elastically supported on the body 2 in a manner movable toward the basal end.

The urging member compartment 2*d* accommodates the urging member 32 in an axially movable manner. The urging member compartment 2*d* is a hole either with the same diameter as or with a smaller diameter than the head joint compartment 2*c*. The urging member compartment 2*d* and the head joint compartment 2*c* may thus be continuous with a step at a basal end of the head joint compartment 2*c*. The urging member 32 is, for example, a compression coil spring. The urging member compartment 2*d* can guide the urging member 32 to be axially centered. The inner bottom of the urging member compartment 2*d* on the basal end functions as a stopper for receiving and stopping the urging member 32.

As shown in FIG. 1, the pin hole 2*f* is a vertical hole for receiving the support pin 33. The pin hole 2*f* extends from the upper surface to the lower surface of the shaft body 2*a* through the hollow part 2*b*.

Load Control

As shown in FIG. 2, the load control 3 elastically supports the head joint 31 in an axially movable manner using the spring force applied from the urging member 32. This structure elastically reduces the pressing load (machining load) caused when the linear slide-contact portion 42*a* in the tip 4 presses the target surface Wa. The load control 3 includes the head joint 31, the urging member 32, and the support pin 33.

The head joint 31 elastically supports a base 41 included in the tip 4 to allow the base 41 to move in the axial direction within a predetermined distance L1 (within a distance corresponding to a difference between the outside diameter of the support pin 33 and the inside diameter of the elliptic hole 31*d* along its major axis). As shown in FIG. 1, the body 2 and the head joint 31 are interconnected with the support pin 33. The head joint 31 has a joint body 31*a*, a tip receptacle 31*b*, the elliptic hole 31*d*, and an urging member support 31*e*.

The joint body 31*a* is defined by the outer circumferential surface of the head joint 31, which is substantially cylindrical and is received in the hollow part 2*b* in a retractable manner. The joint body 31*a* has the elliptic hole 31*d* on its basal end.

The tip receptacle 31*b* is a blind hole for receiving a connection protrusion 41*b* of the base 41. The tip receptacle 31*b* is located at the center of a distal end of the joint body 31*a*.

The elliptic hole 31*d* is a through-hole for receiving the support pin 33 in a manner axially movable by the predetermined distance L1. The elliptic hole 31*d* is formed through the head joint 31 and extends from the upper surface to the lower surface of the head joint 31.

As shown in FIGS. 1 and 2, the urging member support 31*e* supports a distal end of the urging member 32. The urging member support 31*e* is defined by the base face of the head joint 31 and a protrusion. The base face of the head joint 31 receives the distal end of the urging member 32. The protrusion protrudes from the base face and prevents the distal end of the urging member 32 from moving.

The support pin 33 pivotally supports the head joint 31. The support pin 33 is a substantially rod-shaped member extending in the radial direction of the head joint 31 (vertical direction in FIG. 1 and the direction perpendicular to the sheet in FIG. 2). With its middle part extending through the elliptic hole 31*d* and its two ends pivotally supported through the pin hole 2*f* in the body 2 at the top and the bottom of the pin hole 2*f*, the support pin 33 is fastened to the body 2.

The urging member 32 is an elastic member for applying a machining pressure and urging the head joint 31 toward the tip 4. The urging member 32 is a spring for load control, which can adjust the machining pressure for pressing the tip 4 against the target surface Wa (toward the distal end) to an intended value using the head joint 31. The urging member 32 is compressed between the head joint 31 and the inner bottom of the urging member compartment 2*d* in a stretchable manner.

Tip

As shown in FIG. 1, the tip 4 includes the linear slide-contact portion 42*a* (pressing portion) on its distal end. The linear slide-contact portion 42*a* is pressed against the target surface Wa or Wh while moving for burnishing. The tip 4 includes the base 41 and the tip end 42. The tip end 42 is located on a distal end of the base 41. The tip 4 has its linear slide-contact portion 42*a* aligned longitudinally in feed directions (indicated by arrows a and b), and moves the linear slide-contact portion 42*a* on the target surface Wa or Wh in the feed directions for burnishing.

Base

Figure 3:
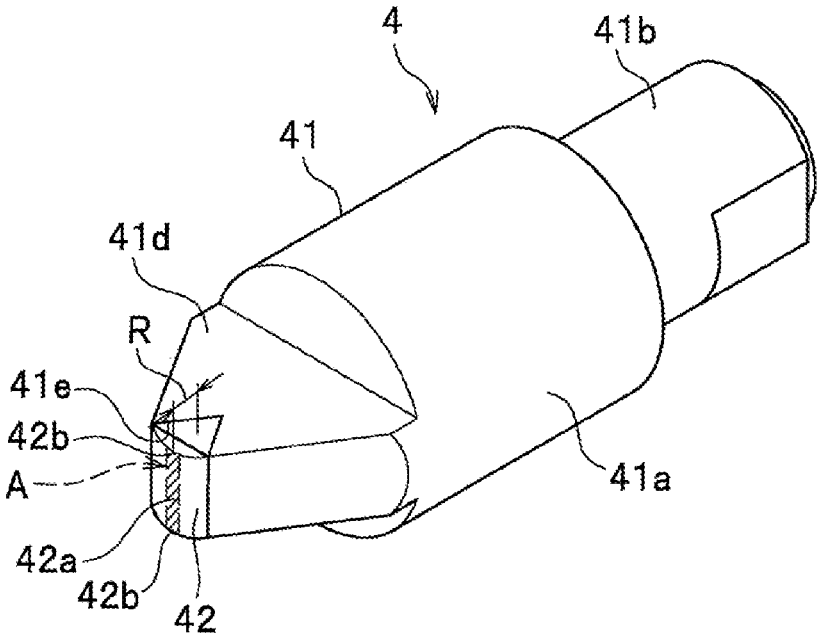
FIG. 3 is an enlarged perspective view of a tip end and a base.

The base 41 is attached to the head joint 31. As shown in FIG. 3, the base 41 has the tip end 42 fixed to its distal end with an adhesive or another connection. The base 41 includes a base body 41*a*, the connection protrusion 41*b*, a trapezoidal protrusion 41*d*, and a tip installation part 41*e*, which are formed integrally.

The base body 41*a* is a cylindrical body.

The connection protrusion 41*b* protrudes from a basal end of the base body 41*a* toward the basal end in the figure. The connection protrusion 41*b* is substantially cylindrical and has a smaller diameter than the base body 41*a*. The connection protrusion 41*b* may not have a smaller diameter than the base body 41*a*, and may have any shape instead of being substantially cylindrical.

The trapezoidal protrusion 41*d* is a tapered trapezoidal plate as viewed from above, which protrudes from a distal end of the base body 41*a*.

The tip end 42 is fixed to the tip installation part 41*e*. The tip installation part 41*e* is, for example, a V-shaped groove formed on a distal end of the trapezoidal protrusion 41*d*. The tip installation part 41*e* may not be a V-shaped groove, and may be in any shape that allows engagement with a basal end of the tip end 42. The tip installation part 41*e* may be in a shape in a cross-sectional view being rectangular, U-shaped, semicircular, arch-shaped, stepped, irregular, or flat. The shape can be determined in accordance with the shape of the basal end of the tip end 42.

Tip End

As shown in FIGS. 1 and 2, the tip end 42 is pressed against the target surface Wa for burnishing. As shown in FIG. 3, the tip end 42 has a semi-cylindrical distal portion. Thus, the tip end 42 includes the linear slide-contact portion 42*a* at its distal end, which slides linearly on the workpiece W (refer to FIG. 4) for burnishing.

Figure 5:
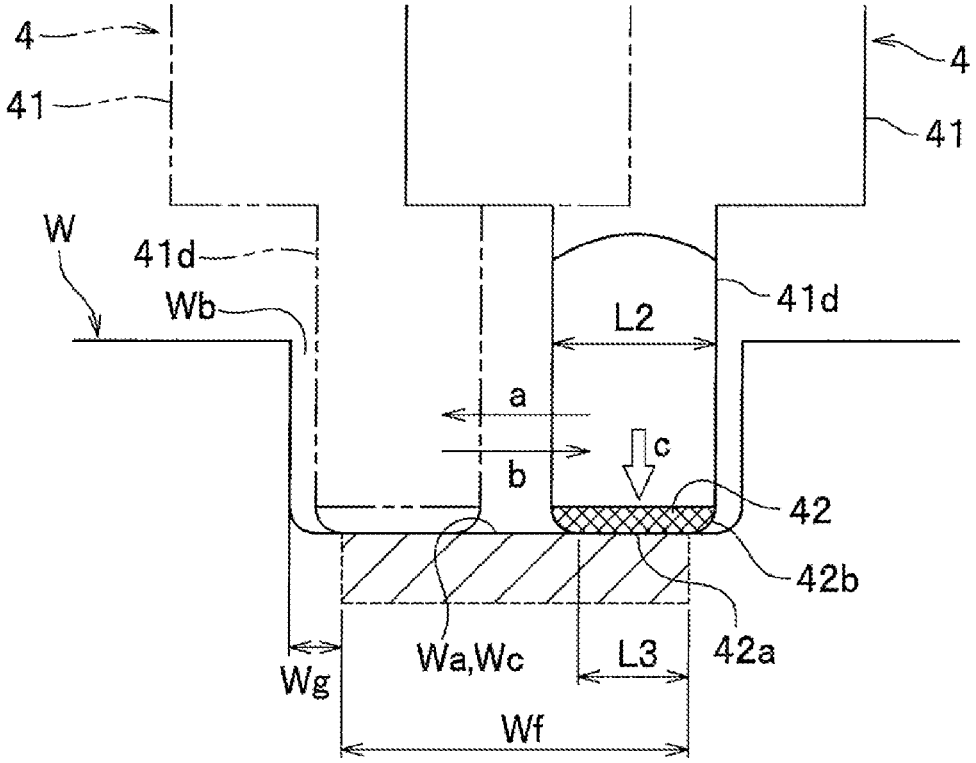
FIG. 5 is a diagram describing an operation for burnishing the bottom of a groove on a workpiece using the tip end fed along the surface.
Figure 6:
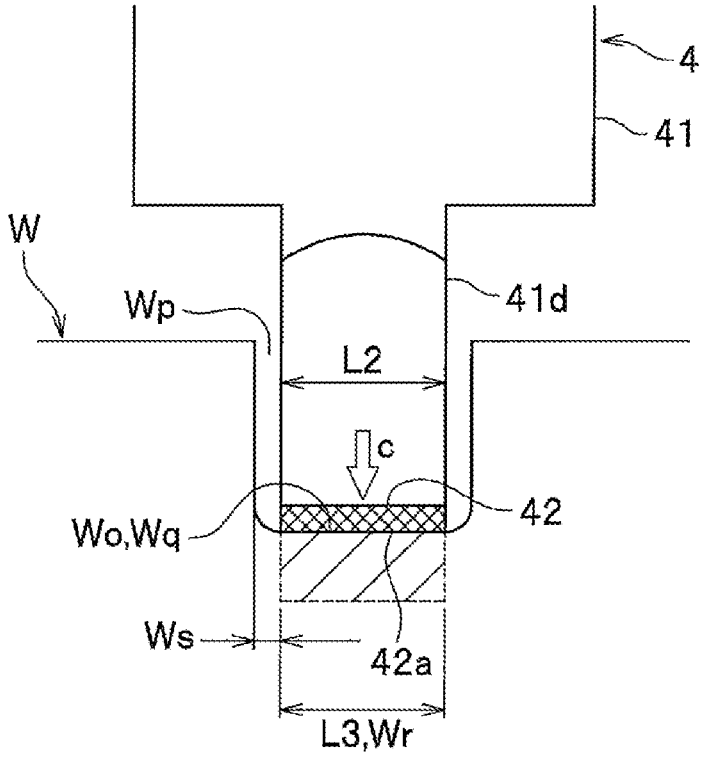
FIG. 6 is a diagram describing an operation for burnishing the bottom of a groove on a workpiece by simply pressing the tip end against the surface.
Figure 7:
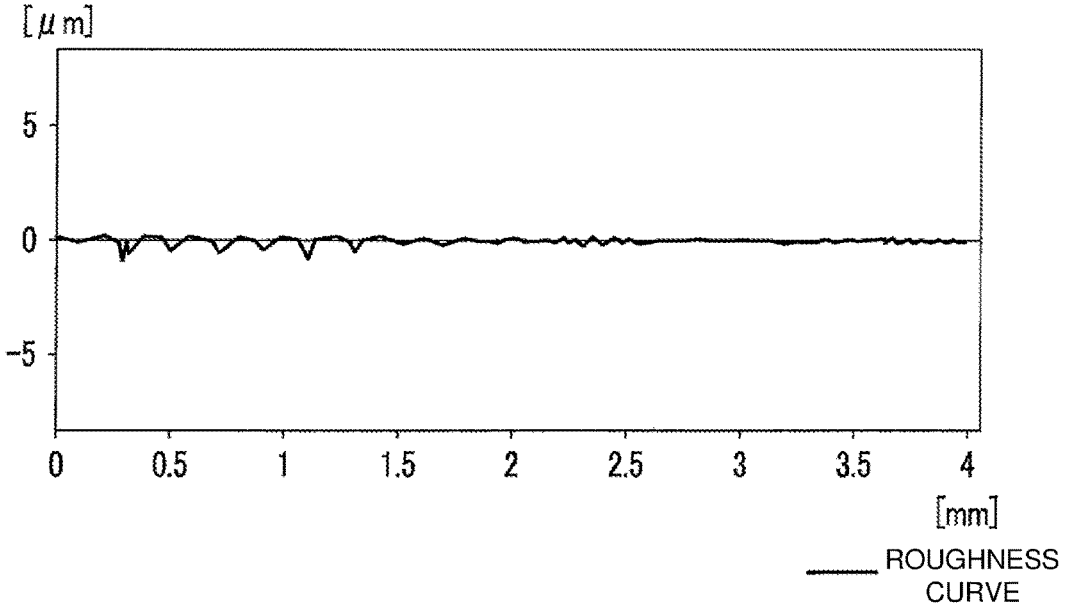
FIG. 7 is a graph showing the surface roughness of a part burnished with the burnishing tool according to the embodiment.
Figure 8:
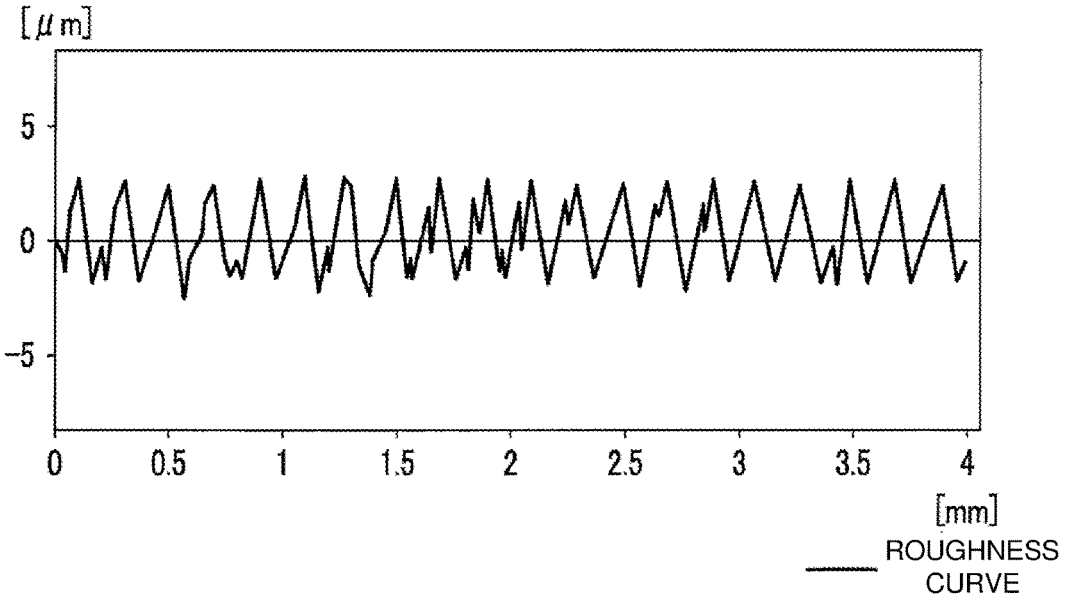
FIG. 8 is a graph showing the surface roughness of a part machined by metal cutting using a general-purpose lathe.

As shown in FIGS. 5 and 6, the tip end 42 has a thickness L2 of, for example, about 2.5 mm in the machining directions (indicated by arrows a and b), and the trapezoidal protrusion 41*d* has a thickness of, for example, about 2.5 mm. As shown in FIG. 5, the tip end 42 has a top chamfered end 42*b* and a bottom chamfered end 42*b* with a radius R of, for example, about 0.4 mm. In this case, the linear slide-contact portion 42*a* (described later) has a length L3 in the machining directions (indicated by arrows a and b) of about 1.7 mm in FIG. 5 and about 2.5 mm in FIG. 6.

The tip end 42 is formed from a hard material, such as industrial diamond, natural diamond, cubic boron nitride (CBN), ceramic, and hard metal.

The tip end 42 formed from hard metal or steel may also be coated with diamond-like carbon (DLC) to harden the surface of the tip end 42.

As shown in FIG. 3, the linear slide-contact portion 42*a* is pressed against the target surface Wa for burnishing. The linear slide-contact portion 42*a* is a ridge on the semi-cylindrical tip end 42. The linear slide-contact portion 42*a* is substantially arch-shaped as viewed from above and is upright as viewed laterally.

The linear slide-contact portion 42*a* may have a cylindrical surface with a radius R of 0.2 to 20 mm, desirably 0.3 to 10 mm, or more desirably 0.5 to 5 mm.

As shown in FIG. 4, when machining the bottom Wj of the groove Wi on the end face We of the workpiece W rotated by the finishing machine, the linear slide-contact portion 42*a* is pressed against the bottom Wj of the rotating workpiece W with a circular path on the bottom Wj of the groove Wi. This allows burnishing in the machining area of the circular target surface Wh.

As shown in FIG. 1, when machining the bottom Wc of the groove Wb on the outer circumferential surface Wd of the workpiece W rotated by the finishing machine, the linear slide-contact portion 42*a* pressed against the bottom Wc of the rotating workpiece W with a circular path on the bottom Wc of the groove Wb. This allows burnishing in the machining area of the cylindrical target surface Wa.

Operation

The operation of the burnishing tool 1 according to the present embodiment will now be described in accordance with the machining procedure with reference to FIGS. 1 to 8.

Pre-machining Before Burnishing

To precisely finish the bottom Wc or Wj (target surface Wa or Wh) of the groove Wb or Wi of the workpiece W, the groove Wb or Wi is pre-machined by, for example, metal cutting before burnishing as shown in FIG. 1. To achieve a finished surface roughness of around 3.0 S or less with the burnishing tool 1, the target surface Wa may be pre-machined to have a roughness in a range of 6.0 to 13.0 S.

Fastening Workpiece and Attaching Burnishing Tool

The workpiece W is fastened firmly on the table of the finishing machine (not shown).

The burnishing tool 1 is attached to the finishing machine and then is moved close to the target surface Wa or Wh. The axis of the workpiece W (rotation axis of the workpiece W) and the axis of the burnishing tool 1 may be aligned parallel to or perpendicular with each other. In the burnishing operation, the tip end 42 of the burnishing tool 1 can be pressed against the workpiece W along the axis of rotation.

Workpiece Burnishing Involving Feeding

For burnishing the bottom Wc of the wide groove Wb as the target surface Wa using the burnishing tool 1 as shown in FIG. 5, the linear slide-contact portion 42*a* at the distal end of the burnishing tool 1 is first placed in contact with the target surface Wa, and is then pressed against the surface by a predetermined distance. For example, the pressing distance may be about 0.1 to 1 mm to determine an optimum machining condition.

The workpiece W is rotated under the appropriate machining condition to have the linear slide-contact portion 42*a* pressed against a machining starting point on the target surface Wa, and is fed in the feed directions (indicated by arrows a and b) to reciprocate on the target surface Wa in the groove Wb for burnishing.

As described above, the burnishing tool 1 is fed while burnishing the workpiece W to increase the machinable area of a machining part Wf to be machined with the linear slide-contact portion 42*a*.

Once the target surface Wa is mirror-finished as appropriate with the linear slide-contact portion 42*a*, the tip end 42 is moved away from the workpiece W to stop rotating the workpiece W. This ends the machining.

As shown in FIGS. 1 and 2, the burnishing tool 1 includes the base 41, and the tip end 42 located on the distal end of the base 41. The tip end 42 includes the linear slide-contact portion 42*a* (refer to FIG. 3), which linearly contacts and slides on the target surface Wa or Wh.

As shown in FIG. 4, the tip end 42 in the groove Wi, such as an O-ring groove, is prevented from contacting the opening edge of the groove Wi, and thus allows machining near the edges of the groove Wi. This reduces an unmachined area Wm.

During burnishing, the linear slide-contact portion 42*a* linearly contacts the workpiece W and thus has a smaller contact area with the workpiece W than when a burnishing tool having surface contact with a workpiece (refer to Patent Literature 1) is used. This reduces the pressing load (indicated by arrow c in FIGS. 5 and 6) used for burnishing, and enables burnishing using a relatively small pressing load. The burnishing tool 1 can machine the workpiece W formed from iron, which is harder than an aluminum alloy.

Further, as shown in FIGS. 1 and 5, the burnishing tool 1 has its linear slide-contact portion 42*a* longitudinally extending in the feed directions (indicated by arrows a and b) and moving in the feed directions for burnishing the target surfaces.

This increases the length of a contact area A between the linear slide-contact portion 42*a* and the workpiece W (refer to FIG. 3) in the feed directions. The contact area A longer in the feed directions shortens the feed distance, and shortens the time for the feed operation and thus the entire machining time.

As shown in FIG. 3, the tip end 42 has a semi-cylindrical distal portion.

A semi-cylindrical portion herein refers to a raised portion shaped like a half-moon in a longitudinal cross-section. The semi-cylindrical portion may be in the shape of a reversed U, a protrusion, an arch, a semicircle, or a semi-ellipse.

As described above, a machining part with a narrow curvature, such as an O-ring groove, can be burnished by moving the chamfered end 42*b* of the tip end 42 to the corners of the bottom Wc or Wj of the groove Wb or Wi as shown in FIG. 1. This reduces an unmachined area Wg or Wm, or an area that is not burnished, in the corners of the bottom Wc or Wj.

The burnishing tool 1 has its linear slide-contact portion 42*a* pressed against the bottom Wc or Wj of the groove Wb or Wi on the workpiece W for burnishing by moving the linear slide-contact portion 42*a* while the workpiece W is rotating. More specifically, the linear slide-contact portion 42*a* is pressed against the bottom Wc or Wj of the groove Wb or Wi on the rotating workpiece W for burnishing.

This structure allows machining near the corners of the groove Wb or Wi. Thus, for example, the bottom Wc or Wj of an O-ring groove including its portions near the edges (side walls) can be burnished to reduce an unmachined area Wg or Wm.

The target surface Wa machined with the burnishing tool 1 can be finished like a mirror surface. The burnished bottom Wc or Wj of the groove Wb or Wi has a smoother surface roughness, and thus provides higher sealing performance. In addition, the bottom Wc or Wj of the groove Wb or Wi as the target surface Wa is pressed with the tip end 42 to cause plastic deformation, which increases the strength of the workpiece more than with metal cutting or grinding.

Burnishing Bottom of Groove on Workpiece Using Pressure from Tip End

Referring now to FIG. 6, burnishing enabled simply by pressing the tip end 42 against a bottom Wq of a groove Wp will now be described with reference to FIG. 6.

As shown in FIG. 6, a narrow groove Wp can be burnished when the tip end 42 can be placed in the groove Wp and pressed against the bottom Wq. For the narrow groove Wp, the burnishing tool 1 is not fed, and the linear slide-contact portion 42*a* is simply placed against the entire bottom Wq of the narrow groove Wp for burnishing.

Simply pressing the burnishing tool 1 without feeding can also reduce the unmachined area Ws in the bottom Wq of the groove Wp.

As described above, the burnishing tool 1 according to the present embodiment can be used for burnishing the bottom Wc, Wj, or Wq of the narrow groove Wb, Wi, or Wp for receiving O-rings or oil seals and can reduce the unmachined area Wg, Wm, or Ws (refer to FIGS. 1 and 6).

First Modification

The invention is not limited to the embodiments described above, and may be changed and modified variously within the scope of its technical idea. It is intended that the appended claims be interpreted as covering all alterations, and modifications as falling within the spirit and scope of the invention. The components that are the same as described in the above embodiments will be given the same reference numerals, and will not be described.

Figure 9:
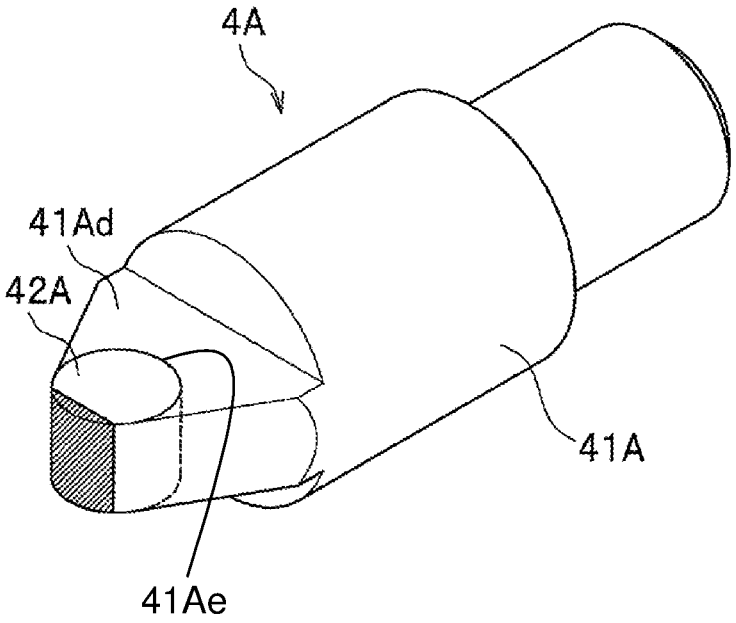
FIG. 9 is an enlarged perspective view of a tip of a burnishing tool according to a first modification.

FIG. 9 is an enlarged perspective view of the tip of a burnishing tool according to a first modification.

The tip 4 according to the embodiment (refer to FIG. 3) may have the cylindrical tip end 42A, or for example, a tip end 4A shown in FIG. 9.

The tip end 42A of the tip 4A is fixed to a tip installation part 41Ae, which is a C-shaped groove as viewed from above, using an adhesive. A distal end of the cylindrical tip end 42A protrudes in the shape of an arch (semi-cylinder) as viewed from above from a trapezoidal protrusion 41Ad. This achieves a smaller corner located in a feed direction in the same manner as for the tip 4 according to the embodiment, and thus can reduce or eliminate an unmachined area.

Second Modification

Figure 10:
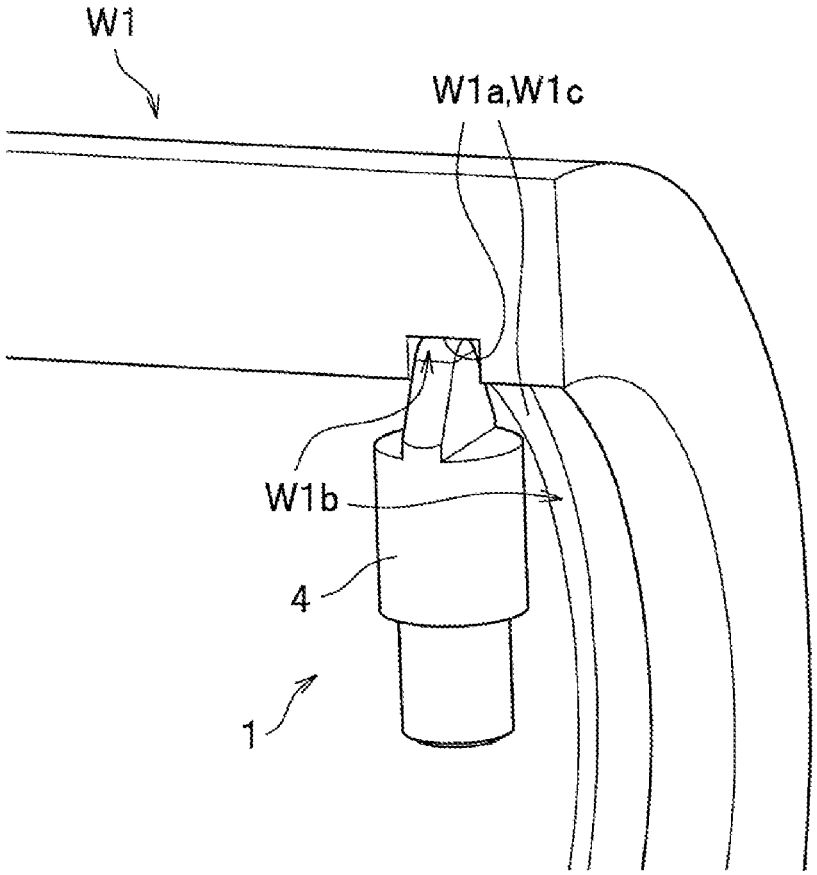
FIG. 10 is an enlarged perspective view of a burnishing tool according to a second modification, including a partial cross-section showing a tip used in machining the bottom of a groove on an inner wall surface of a cylindrical workpiece.

FIG. 10 is an enlarged perspective view of a burnishing tool according to a second modification including a partial cross-section showing a tip used in machining an O-ring groove on an inner wall of a cylindrical workpiece.

Although the bottom Wc or Wj of the groove Wb or Wi, which may be an O-ring groove on the outer circumferential surface Wd and on the end face We serves as the target surface Wa or Wh of the workpiece W in the embodiment as shown in FIG. 1, the embodiment is not limited to this structure.

As shown in FIG. 10, the bottoms of various grooves or various surfaces can be burnished by pressing a table (not shown) of a finishing machine, to which a workpiece W1 is fastened, against a target surface W1*a*.

For example, the target surface W1*a* to be machined with the burnishing tool 1 may be a bottom W1*c* of a groove W1*b* formed on an inner wall of the cylindrical workpiece W1. In other words, the workpiece W1 to have a cylindrical inner surface to allow the burnishing tool 1 to be fed onto the surface.

Third Modification

Figure 11A:
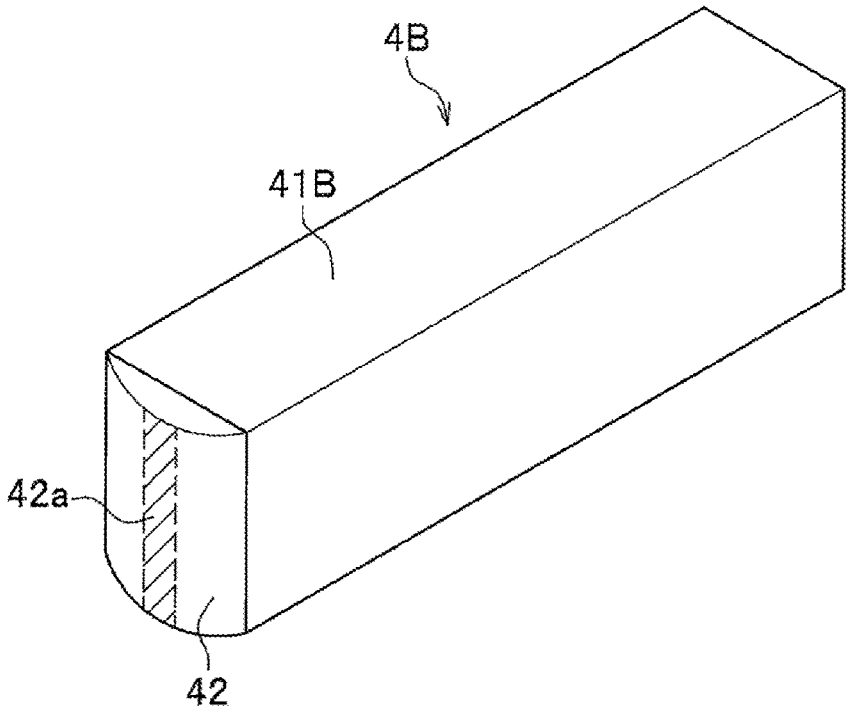
FIG. 11A is an enlarged perspective view of a burnishing tool according to a third modification showing a tip including a square base.
Figure 11B:
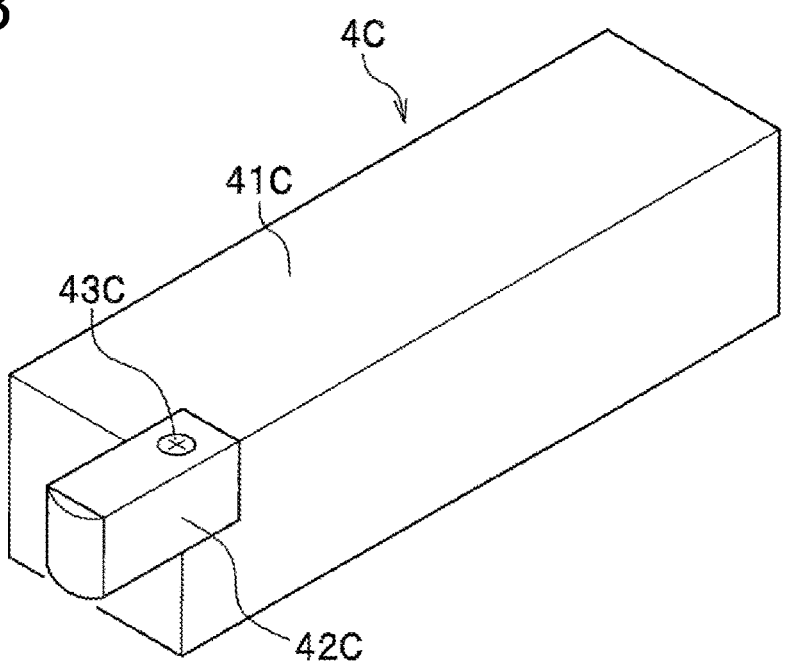
FIG. 11B is an enlarged perspective view of a burnishing tool according to the third modification showing a tip including a base on which a tip end is fastened using a screw.

FIG. 11A is an enlarged perspective view of a burnishing tool according to a third modification showing a tip including a square base. FIG. 11B is an enlarged perspective view of the burnishing tool according to the third modification showing a tip including a base on which a tip end is fastened using a screw.

The base 41 may not have the shape shown in FIG. 3. When the load control 3 is eliminated, a base 41B may be a simple quadrangular prism or a cylinder (not shown) and may have any shape as in a tip 4B shown in FIG. 11A.

A base 41C may be prepared separately, and a tip end 42C may be fastened to the base 41C using a screw 43C as in a tip 4C shown in FIG. 11B.

Other Modifications

The burnishing tool 1 can be used for burnishing the target surface Wa, Wh, or Wo shown in FIGS. 1 and 6, which may be a surface recessed from the surface of the workpiece W or may be the surface of the workpiece W. The burnishing tool 1 can be used for burnishing the target surface Wa, Wh, or Wo of the workpiece W that allows contact with the tip end 42.

The groove Wb, Wi, or Wp shown in FIGS. 1 and 6, which can be burnished, may not be annular. The target surface Wa, Wh, or Wo of the groove Wb, Wi, or Wp may be the bottom of a groove in a shape being linear, curved, or polygonal, or annular on an outer circumferential surface of a cylinder, or in any shape on a flat surface.

Although the tip 4 according to the above embodiment includes the base 41 and the tip end 42 formed from a hard material, such as diamond or a hard metal, attached using an adhesive, the tip 4 may have any other structure. For example, the tip may have its tip end 42 welded to or embedded in the base 41.

Although the tip end 42 includes the linear slide-contact portion 42*a* with the shape defined by an arch-like curve cut from a cylinder with a perfect circle as viewed from above as shown in FIGS. 2 and 3, the tip end 42 may have any shape that has a predetermined radius of a curvature on its distal end. For example, the linear slide-contact portion 42*a* may have a curved line defining a part of an ellipse as viewed from above.

REFERENCE SIGNS LIST

1 burnishing tool
2 body
4, 4A, 4B, 4C tip
41, 41A, 41B, 41C base
42, 42A, 42C tip end (tip portion)
42*a* linear slide-contact portion
W, W1 workpiece
Wa, Wh, Wo target surface
Wb, Wi, Wp groove
Wc, Wj, Wq bottom
Wf, Wk, Wr machined area
Wg, Wm, Ws unmachined area

What is claimed is:

1. A burnishing tool for machining a target surface of a workpiece, the tool comprising:
- a base including
  - a base body,
  - a protrusion protruding perpendicularly from a distal end face of the base body and extending in a longitudinal direction, the protrusion haying at least two parallel sides defining a base of the protrusion at a proximal end of the protrusion, the base of the protrusion being in direct contact with the distal end face and extending therefrom, and
  - a tip installation part; and
- a tip portion located on a distal end of the protrusion, the tip portion including a linear slide-contact portion unrotatably fixed to the tip portion, the linear slide-contact portion configured to linearly contact and slide on the target surface, the tip installation part engaging with a basal end of the tip portion,
- the linear slide-contact portion having a contact surface which has a first dimension and a second dimension, the first dimension being along a feed direction of the burnishing tool and being larger than the second dimension, and
- the protrusion having a thickness equal to the first dimension of the contact surface.

2. The burnishing tool according to claim 1, wherein
- the linear slide-contact portion is movable in the feed direction while being aligned longitudinally in the feed direction.

3. The burnishing tool according to claim 1, wherein
- the tip portion includes a distal end with a cross-sectional shape selected from a circle, a reversed U, an arch, a semicircle, or a semi-ellipse.

4. The burnishing tool according to claim 1, wherein
- in a burnishing operation, the linear slide-contact portion is pressed against a bottom of a groove on a rotating workpiece.

5. The burnishing tool according to claim 2, wherein
- the tip portion includes a distal end with a cross-sectional shape selected from a circle, a reversed U, an arch, a semicircle, or a semi-ellipse.

6. The burnishing tool according to claim 2, wherein
- in a burnishing operation, the linear slide-contact portion is pressed against a bottom of a groove on a rotating workpiece.

7. The burnishing tool according to claim 3, wherein in a burnishing operation, the linear slide-contact portion is pressed against a bottom of a groove on a rotating workpiece.

8. The burnishing tool according to claim 5, wherein in a burnishing operation, the linear slide-contact portion is pressed against a bottom of a groove on a rotating workpiece.

9. The burnishing tool according to claim 1, wherein the tip portion is made of industrial diamond, natural diamond, cubic boron nitride (CBN), ceramic, or hard metal.

10. The burnishing tool according to claim 1, wherein the tip installation part has a cross-sectional shape selected from a V-shape, rectangular, U-shape, semi-circle, arch-shape, step-shape, irregular, or flat.

11. The burnishing tool according to claim 1, further comprising:

a body having a hollow part at a distal end;

a head joint supporting the tip portion at a distal end, the head joint having an elliptic hole extending in an axial direction, the head joint accommodated in the hollow part in a manner movable along the axial direction;

a support pin penetrating the elliptic hole to be arranged on the body; and an urging member arranged in the hollow part, the urging member configured to urge the head joint toward a distal end.

12. The burnishing tool according to claim 11, wherein the urging member elastically supports the head joint in the axial direction to elastically reduce a pressing load caused when the linear slide-contact portion presses the target surface of the workpiece.

* * * * *